United States Patent [19]

Pertinen

[11] 4,171,752

[45] Oct. 23, 1979

[54] VENDING MACHINE LOCKING APPARATUS

[75] Inventors: Raymond W. Pertinen, Minneapolis, Minn.

[73] Assignee: Gross-Given Manufacturing Company, Saint Paul, Minn.

[21] Appl. No.: 892,185

[22] Filed: Mar. 31, 1978

[51] Int. Cl.[2] ..... G07F 11/16

[52] U.S. Cl. ..... 221/84; 221/152; 221/261

[58] Field of Search ..... 221/82–86, 221/151, 152, 154, 155, 261, 312 R

[56] References Cited

U.S. PATENT DOCUMENTS

| | | | |
|---|---|---|---|
| 1,821,501 | 9/1931 | Du Grenier | 221/83 |
| 3,114,473 | 12/1963 | Weber | 221/155 X |
| 3,194,432 | 7/1965 | Breitenstein et al. | 221/82 |
| 3,227,307 | 1/1966 | Auerbach et al. | 221/84 |
| 3,286,880 | 11/1966 | Gross | 221/82 |
| 3,724,717 | 4/1973 | Goto | 221/155 |

FOREIGN PATENT DOCUMENTS

| | | | |
|---|---|---|---|
| 442407 | 2/1936 | United Kingdom | 221/84 |

*Primary Examiner*—Robert J. Spar
*Assistant Examiner*—Edward M. Wacyra
*Attorney, Agent, or Firm*—Merchant, Gould, Smith, Edell, Welter & Schmidt

[57] ABSTRACT

An improved locking system for a vending machine of the type comprising a plurality of vertical magazines each consisting of an endless belt having a plurality of spaced trays thereon. A receiving tray mounted below each of the belts has a lock lever associated therewith. The lock lever is normally biased into a first position which prevents unauthorized rotation of the receiving tray to prevent the dispensing of a product held thereon. Rotation of the endless belt forward causes one of the trays thereon to engage the lock lever to move it to a second position to unlock the receiving tray and thereafter engages the receiving tray to pivot such tray to a dispensing position.

8 Claims, 4 Drawing Figures

FIG. 1
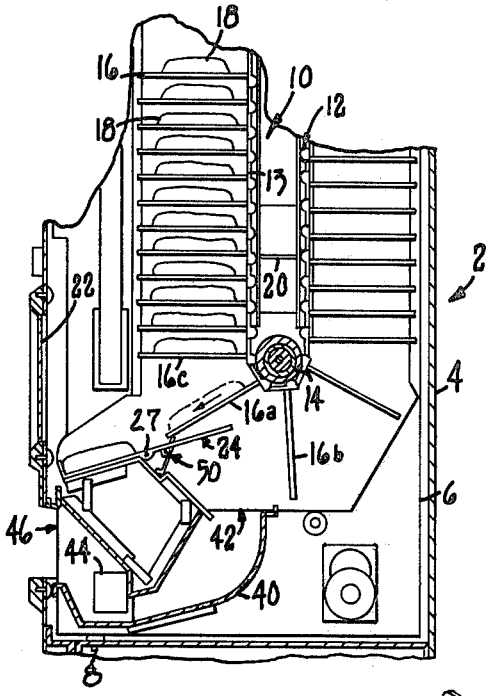
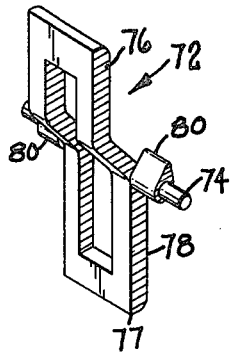
FIG. 4
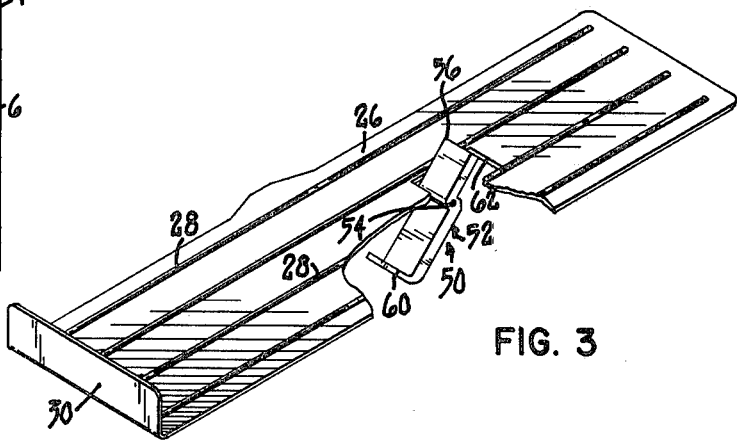
FIG. 3
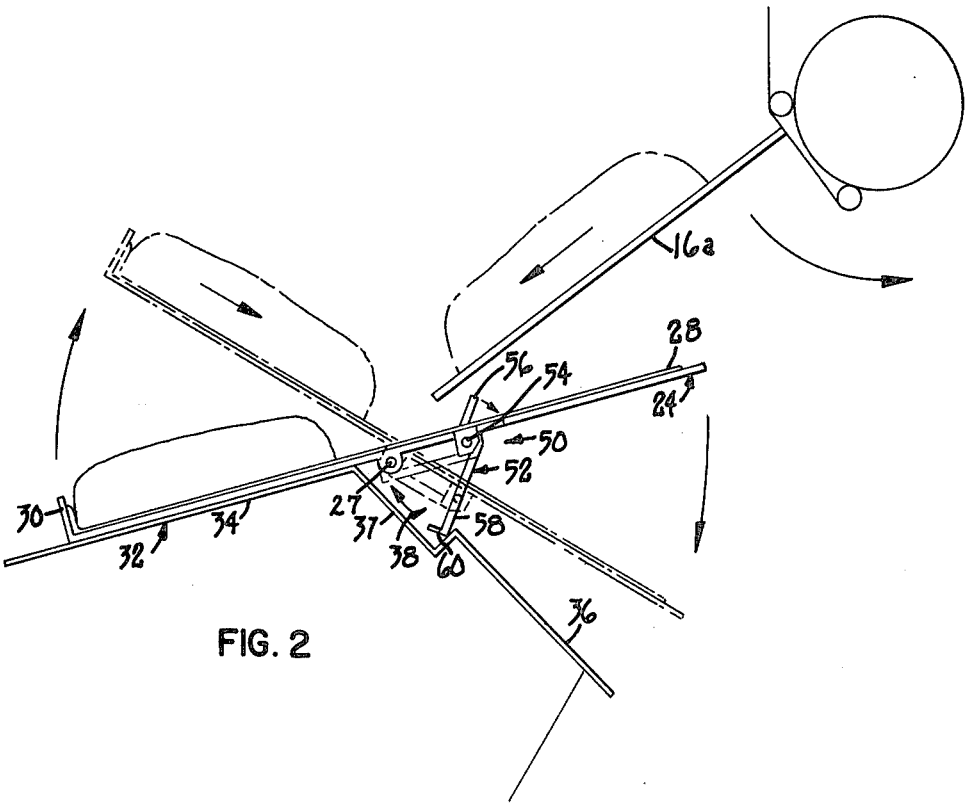
FIG. 2

VENDING MACHINE LOCKING APPARATUS

BACKGROUND OF THE INVENTION

1. Field of the Invention

This invention relates in general to automated vending machines for selectively dispensing any of a plurality of food products or other dispensable units of merchandise. More particularly, this invention relates to an automated vending machine of the type comprising a plurality of vertical magazines each of which consists of an endless belt having a plurality of spaced product carrying trays thereon.

2. Description of the Prior Art

Automated vending machines are widely used for dispensing pre-packaged food products when a purchaser inserts the required amount of money and activates the appropriate control mechanisms. Such vending machines have a number of advantages. For example, they can be placed in many locations (e.g., in parks, gas stations, etc.) where, for various reasons, it is not feasible to have a snack shop or stand, requiring the presence of a full-time operator, to vend the same products. Vending machines also require less space and are less expensive to construct than snack shops. In addition, because vending machines do not require the constant presence of an operator to vend the food products to the purchaser, they are somewhat less expensive to operate than snack shops. All of these advantages and others have contributed to the popularity of automatic vending machines.

The specific structure of vending machines varies widely depending on the type of food product being dispensed and other factors. U.S. Pat. No. 3,286,880, issued to Arthur R. Gross and assigned to the assignee of this invention, is an example of one type of automatic vending machine. In the vending machine disclosed in this patent, a plurality of magazines are provided for holding a variety of articles, such as different brands of candy bars. Each magazine includes an endless belt having a plurality of uniformly spaced trays rigidly mounted thereon and extending perpendicularly to the belt. Each tray carries one unit of merchandise (e.g., the candy bar) which slides off the tray as the endless belt moves around the lower pulley. Prior to this unit sliding off the tray, the empty preceding tray on the endless belt engages a pivotably mounted receiving tray. The receiving tray already has thereon the unit of merchandise which had been carried on the preceding tray. Upon engagement by the preceding tray, the receiving tray is tilted to allow the unit thereon to slide down into a chute leading to an externally accessible slot in the front of the machine. As the enddless belt continues rotating, the preceding tray is disengaged from the receiving tray. Subsequently, the unit on the next tray slides onto the receiving tray returning it to its normal position awaiting another dispensing cycle.

Although the above-noted machine is quite effective for dispensing various products, it has been possible in some instances to cheat or defeat the machine. This allows one to gain access to at least some of the food products contained in the machine without paying the purchase price. In this regard, each of the receiving trays for each of the magazines is normally prevented from rotating by a locking bar. This prevents the products from being removed from the receiving trays before the purchase thereof. All of the locking bars for all of the receiving trays are mounted on the same transverse locking shaft. This shaft is operated to unlock the locking bars whenever the endless belt in any one of the magazines is selectively activated by a motive means. However, because all of the locking bars are mounted on this shaft, whenever the shaft is rotated to unlock one of the locking bars, all of the other locking bars for the other receiving trays are also unlocked.

It has been possible in the past for wires or other elongated members to be threaded upwardly through the access slot and the product carrying chutes to hook onto the back of each of the receiving trays. Thus, when the cheater places a certain amount of money in the machine to cause one product to be vended, the locking shaft is rotated to unlock all of the locking bars. Since all of the receiving trays are now unlocked, the wires can be used to actuate all of the receiving trays in addition to that one for which the money has been paid. This gives the cheater a plurality of food products from all of the magazines across the width of the machine instead of just the one he has payed for. In addition to the revenue which is lost due to the stolen products, for all those magazines whch have been cheated the next purchaser sees only an empty receiving tray in the product viewing window. This purchaser believes that the machine is empty even though all of the other trays in the cheated magazines may in fact be loaded wth products. This means that the vending machine is not fully utilized since a serviceman must come to refill the receiving trays in the cheated magazines before further vending can continue. The need for such servicing, which may be quite frequent if the ability to cheat the machine is widely known, increases the costs of operating the machine. In addition, the time during which purchasers believe the machine is empty is non-productive and further decreases the amount of revenue obtainable from the machine.

SUMMARY OF THE INVENTION

Thus, it is an aspect of this invention to provide a vending machine of the above-noted type in which the receiving trays cannot be cheated.

This invention comprises an improved automatic vending machine of the general type shown in U.S. Pat. No. 3,286,880 and described above. More specifically, this invention comprises an improved locking means for the receiving trays in the vending machines. This locking means includes a plurality of lock levers which are each individually associated with one of the receiving trays. The lock levers are biased such that an actuating portion thereof extends above the surface of the receiving tray into the path of movement of the product carrying trays on the conveying member. As the product carrying tray approaches the receiving tray, it engages the lock lever associated with the receiving tray to move the lock lever to an inoperative position which allows the receiving tray to be pivotted. Thus, continued rotation of the product carrying tray will cause such tray to engage the receiving tray pivotting it to a dispensing position where a unit of merchandise carried on the receiving tray is dispensed. However, none of the lock levers of any of the other receiving trays have been engaged or actuated. Unauthorized actuation of these receiving trays is therefore prevented.

BRIEF DESCRIPTION OF THE DRAWINGS

This invention will be described hereafter in the Detailed Description, when taken in conjunction with the following drawings, in which like reference numerals will refer to like elements throughout.

FIG. 1 ia a partial cross-sectional view of an improved vending machine according to this invention;

FIG. 2 is a side elevational view of the receiving tray and an associated lock lever according to this invention, illustrating the position of a product carrying tray thereabove before the dispensing of a unit contained in the receiving tray;

FIG. 3 is a perspective view of a receiving tray and an associated lock lever of this invention; and FIG. 4 is a perspective view of a second embodiment of the lock lever according to this invention.

DETAILED DESCRIPTION

Referring first to FIG. 1, an improved automated vending machine according to this invention is generally indicated as 2. Vending machine 2 is preferably meant for dispensing a plurality of prepackaged food products, such as candy bars or the like. However, vending machine 2 may be used to dispense any type of vendable product or unit of merchandise, whether or not that product comprises food. More particularly, vending machine 2 is of the type disclosed in U.S. Pat. No. 3,286,880, issued to Arthur R. Gross on Nov. 22, 1966, which is assigned to the assignee of this invention. The above-noted patent is hereby incorporated by reference with regard to the details concerning the structure and operation of vending machine 2. However, vending machine 2 will be described herein insofar as is necessary to an understanding of this invention which relates to an improved receiving tray locking system 50.

Vending machine 2 has an outer case or housing 4 in which a subcomponent 6 is pivotably mounted as at 8. Only the lower pivot 8 is illustrated in FIG. 1 on subcomponent 6 but a substantially identical upper pivot (not shown) is also provided. subcomponent 6 forms a frame which mounts a plurality (e.g., ten) of side-by-side vertically extending dispensing magazines 10. Only one magazine 10 is illustrated in FIG. 1. However, all the other magazines 10 are substantially identical to the magazine 10 which has been illustrated. Magazines 10 extend transversely across most of the width of housing 4. Subcomponent 6 is pivotally mounted in housing 4 to allow the subcomponent to be horizontally swung out of housing 4 to ease the task of loading magazines 10 with vendable units of merchandise.

Each dispensing magazine 10 includes an elongated conveying member such as an endless belt 12. Endless belt 12 is journaled around a lower sprocket 14 and an upper sprocket (not shown) to rotatably mount endless belt 12 in magazine 10. Endless belt 12 has a plurality of outwardly extending product carrying trays 16. Each tray 16 extends outwardly from belt 12 at a right angle relative thereto. This allows each of the trays 16 to carry a vendable unit of merchandise 18 on its upper surface in a substantially horizontal orientation at least until the tray 16 rotates around the lower sprocket 14 where each of the products 18 slide off the trays 16 in a manner to be described hereafter. Each of the trays 16 may be integrally formed or made with one of the links 13 which comprise endless belt 12 However, trays 16 could also comprise any suitable planar member attached to the links of a conventional conveyor chain or the like.

Each of the endless belts 12 in each of the magazines 10 may be selectively and individually coupled to a motive means for actuating the belts 12. The motive means generally includes a reciprocal carriage 20 driven by a motor (not shown a manner noted in the above-referenced patent to Gross. Carriage 20 advances any selected one of the belts 12 forwardly one position to dispense a pre-selected food product 18. In this regard, housing 4 has a window 22 in its front side through which a purchaser may view the interior of vending machine 2. More particularly, window 22 affords the purchaser a view of a plurality of receiving trays 24 which display the next food product 18 to be dispensed in each of the magazines 10.

Each receiving tray 24 is pivotably mounted in each of the magazines 10 for rotation about a pivot axis defined by pivot rod 27. Pivot rod 27 lies generally in the plane of receiving tray 24. As shown in FIG. 1, each receiving tray is spaced below and in front of the lower sprocket 14 of endless belt 12. Referring to FIG. 3, each receiving tray 24 includes an upper support surface 26 and a plurality of support ribs 28. The lowermost end of tray 24 has an upwardly turned flange 30 against which any products 18 on the receiving tray 24 will abut.

As shown in FIG. 2, a support member 32 having a first support surface 34 and a second support surface 36 is positioned in each magazine 10 below the receiving tray 24. First support surface 34 limits the pivotal movement of the receiving tray 24 and defines a first or normal position of the tray. In this first position, receiving tray 24 is slanted downwardly toward the front of vending machine 2. Any food product 18 contained on the tray 24 is supported by the ribs 28 above the shelf surface 26 and is prevented from sliding off the tray by flange 30. A viewer looking through the window 22 is able to view all of the products 18 contained on all of the receiving trays 24 in all of the magazines 10 to determine which product 18 to purchase. In addition, the second support surface 36 of support member 32 has therein a notch or recess 38. The purpose of notch 38 will be described hereafter.

Each magazine 10 further has a chute 40 positioned below the support member 32 In particular, chute 40 has an opening 42 which is adapted to receive the product 18 contained on the receiving tray 24 during a dispensing operation. In this regard, receiving tray 24 is pivotted from its first position against support surface 32 to a second tilted position (shown in phantom in FIG. 2) to allow the product 18 to slide off tray 24 down into chute 40. Chute 40 carries the product 18 downwardly into a discharge space 44. Discharge space 44 in each of the magazines 10 is accessible through an external receiving slot 46. Thus, the purchaser after purchasing one of the products 18, can extend his hand inwardly through the slot 46 to remove the purchased product.

Referring now in more detail to the operation of vending machine 2, vending machine 2 has an initial position illustrated in FIG. 1 preceeding the purchase of any product 18. In this position, an adjacent one of the trays 16, i.e., tray 16*a*, is positioned immediately above receiving tray 24 at the conclusion of a prior dispensing operation. The product 18 which had previously been positioned on tray 16*a* has slid off of the tray down onto the upper surface 26 of receiving tray 24. Assuming then that the purchaser wishes to purchase the product 18 supported on tray 24 and that he inserts the required amount of money into machine 2 and activates the appropriate control mechanism (not shown), endless belt 12 will be rotated forwardly one position moving the tray 16*a* from the position shown in FIG. 1 to the position previously occupied by tray 16*b*. During this movement of tray 16*a*, tray 16*a* will engage the rear half of receiving tray 24 to pivot receiving tray 24 about its pivot rod 27 from its first to its second position. This causes the product 18 on tray 24 to slide off of the receiving tray 24 downwardly into the chute 40 for manual removal in the manner described before. The next succeeding tray, i.e., tray 16*c*, will also be moved downwardly to the position previously occupied by tray 16*a* at the initiation of the dispensing cycle. As tray 16*c* reaches this position, the product 18 contained on tray 16*c* will slide downwardly off the tray 16*c* and onto receiving tray 24 to pivot the tray 24 back to its first or normal position. This resets receiving tray 24 for another cycle of operation. If tray 24 is designed to be counterweighted towards its first position, tray 24 would reset even without another product 18 dropping onto its upper surface.

This invention relates to a system or means for normally locking each of the receiving trays 24 in each of the magazines 10. This receiving tray locking means is generally indicated as 50. Locking means 50 comprises a plurality of individual and identical lock levers 52. Each lock lever 52 is pivotably mounted by a pivot pin 54 to the underside of one of the receiving trays 24. Lock lever 52 has a first leg 56 disposed on one side of pivot pin 54. In addition, lock lever 52 has a second leg 58 disposed on the other side of pivot pin 54 in an opposed manner. Second leg 58 terminates at its free end in an upwardly extending stop flange 60. Lock levers 52 may be made of any suitable material. However, they are preferably injection molded from a high-impact plastic, such as standard high-impact ABS plastic.

First leg 56 normally extends through a rectangular slot or opening 62 in the upper surface 26 of receiving tray 24. Because the arm 56 is shorter than the arm 58 and the arms are spaced on opposite sides of pivot pin 54, lock lever 52 is counterweighted into a first position so that first leg 56 is normally biased above the upper surface 26 of receiving tray 24 as shown in FIG. 2. More particularly, the location of pivot pin 54 on lock lever 52 is so chosen such that the leg 56 as it extends above the upper surface 26 of the receiving tray 24 is located in the path of rotation of each of the trays 16 on the endless belt 12. In this regard, first leg 56 might be said to comprise an actuating portion of lock lever 52. In addition, pivot pin 54 is so located in relation to notch 38 that the top flange 60 is normally positioned in the notch 38 in an interfering relationship relative to a side wall 37 of notch 38 when lock lever 52 is in its first position.

The locking means 50 is effective in preventing unauthorized dispensing or tripping of each of the receiving trays 24. In this regard, if someone were to thread a wire or other trip mechanism through the chute 40 to connect to the rear edge of receiving tray 24, such a trip mechanism will still not be effective to dispense a product 18. Any attempted manual forcing or pivotting of the rear of tray 24 downwardy will cause the stop flange 60 to abut against the side wall 37 of notch 38. This locks receiving tray 24 in place and prevents such receiving tray from being pivotted to the second dispensing position. Receiving tray 24 is unlocked for dispensing only by the engagement of first leg 56 of lock lever 52 by one of the trays 16. Thus, as a tray 16, e.g., tray 16*a*, begins moving downwardly to engage receiving tray 24 to dispense the product 18 thereon, tray 16*a* first engages the leg 56. This engagement rotates lock lever 52 in a clockwise direction about pivot pin 54 from its first normal position to a second inoperative or unlocking position shown in phantom in FIG. 2. In the second position of lock lever 52, stop flange 60 of leg 58 now contacts the underside of receiving tray 24 and is no longer in an interfering relationship with regard to side wall 37 of notch 38. In addition, leg 56 has been rotated downwardly into opening 62 and is generally flush with upper surface 26 of receiving tray 24. Thus, receiving tray 24 can now be freely pivotted by tray 16*a* between its first and second positions to dispense product 18 into chute 40.

The locking means 50 according to this invention is particularly advantageous in that it is relatively inexpensive and substantially foolproof in operation. A plurality of lock levers 52 are each individually associated with one of the receiving trays 24. In addition, each of these lock levers 52 can only be unlocked by rotation of the endless belt 12 in the magazine 10 which the purchaser has selected and for which he has paid the purchase price. There is no centralized locking mechanism as in the prior art for all of the receiving trays 24 which allows all of these to be tripped whenever that centralized locking mechanism is released by the purchase of but a single product. Thus, locking means 50 ensures that no more than one receiving tray 24 on the machine 2 can be activated when purchasing one product 18. In addition, since no centralized mechanism is needed to connect and actuate lock levers 52, these levers are simpler and less complex that the prior art arrangement noted above. Lock levers 52 need only be tripped by one of the trays 16. This inherently occurs whenever endless belts 12 are moved forwardly one position. Thus, locking means 50 is highly reliable.

Referring now to FIG. 4, a second embodiment for the lock lever which forms the locking means 50 is generally indicated as 72. Each lock lever 72 has first and second legs 76 and 78 spaced on either side of a pivot pin 74. Legs 76 and 78 are similar to the legs 56 and 58 on each of the lock levers 52. However, leg 78 does not terminate in a stop flange 60 as does leg 58. Instead, the free end 77 of the leg 78 will be effective to engage the side wall 37 of notch 38 whenever the lock levers 72 are in their first position to normally prevent receiving trays 24 from being pivotted. The leg 76 extends above the upper surface of the receiving tray 24 in a manner identical to the leg 56 for actuation of lock levers 72 by trays 16. The operation of lock levers 72 is identical to the operation of levers 52.

Lock lever 72 further has two outwardly extending lugs or shoulders 80 spaced on either side of the body of lock lever 72 about the pivot pin 74. When lock lever 72 is pivotally mounted on receiving tray 24, shoulders 80 are positioned beneath the receiving tray 24. Any attempted manual forcing or pivotting of the lock lever 72 in a counter-clockwise direction in an attempt to defeat the purpose of lock lever 72 will cause the shoulders 80 to abut against the bottom surface of receiving tray 24. Thus, it is impossible for a trip wire or the like to be used to engage the downwardly extending leg 78 in an attempt to swing the leg 78 out of notch 38 such that leg 78 would no longer be effective to lock receiving tray 24. Shoulders 80 could also be incorporated on the lock levers 52 is so desired.

Various other modifications of this invention will be apparent to those skilled in the art. For example, a counterweighted configuration for lock levers 52 only provides a preferred means for biasing the lock lever into its normal locking position in which the first leg 56 extends above the upper surface 26 of receiving tray 24. Various other means of biasing the lever to achieve this effect could be used. In this regard, lock lever 52 could have equal sized legs. First leg 56 could still be biased above the surface 26 by a suitable spring attached between the lock lever and a portion of the machine (e.g., between leg 58 and the underside of tray 24) for biasing the lock lever to its normal position. Movement of the trays 16 would be effective to overcome the biasing effect of the spring to rotate the lock lever 52 from its first locking position to its second unlocking position. Thus, the scope of this invention is to be limited only by the appended claims.

What is claimed is:

1. An improved vending machine, which comprises:

(a) a plurality of magazines for storing units to be selectively dispensed, each magazine including a conveying member having a plurality of trays spaced thereon and rigidly mounted thereto;

(b) motive means for selectively advancing each of the conveying members one position in a step-by-step manner;

(c) a receiving tray associated with each of the magazines, each receiving tray being pivotably mounted for movement between first and second positions, each receiving tray further being mounted for engagement by an adjacent one of the trays attached to the conveying member when the conveying member is advanced one position to rotate the receiving tray from its first to its second position to dispense a first unit held on the receiving tray, a second unit subsequently dropping off the next adjacent tray onto the receiving tray to return the receiving tray to its first position; and (d) means for normally locking the receiving trays in their first position, the locking means comprising a plurality of lock levers each of which are individually associated with one of the receiving trays for movement between first and second positions, each lock lever in its first position having an actuating portion which extends at least partially above the surface of the receiving tray and into the path of movement of the adjacent one of the trays, whereby the adjacent one of the trays engages the actuating portion of the lock lever as it is advanced one position to cause the lock lever to move to its second position which allows the receiving tray to rotate to its second position to thereby dispense the unit contained thereon.

2. An improved vending machine as recited in claim 1, in which each of the lock levers includes means for biasing the lock lever to its first position wherein the actuating portion thereof extends above the surface of the receiving tray.

3. An improved vending machine as recited in claim 2, in which each of the lock levers are pivotally mounted on the corresponding receiving trays for rotation about a pivot point, and wherein the biasing means for each of the lock levers comprises a counterweighted configuration of the lock levers about the pivot points thereof.

4. An improved vending machine as recited in claim 1, in which the lock levers are pivotally mounted on the corresponding receiving trays for rotation about a pivot axis, and wherein the actuating portion of each lock lever comprises a first leg thereof, each lock lever further having a second leg oppositely disposed with respect to the first leg about the pivot axis of the lock lever, the second leg being longer than the first leg to counterweight each lock lever to its first position at which the first leg extends above the surface of the receiving tray.

5. An improved vending machine as recited in claim 4, in which the second leg of each lock lever has a locking flange which is suited for engaging a fixed support surface in the magazine to prevent unauthorized rotation of the receiving tray when the lock lever is in its first position.

6. An improved vending machine as recited in claim 5, in which the locking flange in the first position of the lock lever is spaced from and oriented in an interfering relationship relative to the fixed support surface, whereby any unauthorized rotation of the receiving tray causes the locking flange to abut against the fixed support surface to prevent any further rotation of the receiving tray, the locking flange being moved to a non-interfering relationship with the fixed support surface when the lock lever is rotated to its second position to allow the receiving tray to be freely rotated.

7. An improved vending machine as recited in claim 1, in which the lock levers are integrally formed of plastic and are pivotably mounted on the underside of the corresponding receiving trays.

8. An improved vending machine, which comprises:

(a) a plurality of magazines for storing units to be selectively dispensed, each magazine including a conveying member having a plurality of trays spaced thereon and rigidly mounted thereto;

(b) motive means for selectively advancing individually each of the conveying members one position in a step-by-step manner to dispense a selected unit;

(c) a receiving tray associated with each magazine, each receiving tray being pivotably mounted for movement between first and second positions, each receiving tray further being mounted for engagement by an adjacent one of the trays attached to the conveying member when the conveying member is advanced one position to rotate the receiving tray from its first to its second position to dispense a first unit held on the receiving tray, a second unit subsequently dropping off the next adjacent tray onto the receiving tray to return the receiving tray to its first position, and (d) means for normally locking the receiving trays in their first positions, the locking means comprising a plurality of locking members each of which are individually associated with one of the receiving trays, each locking member being individually actuated by the adjacent one of the trays on the conveying members as it advances one position to allow the receiving tray to rotate to its second position to thereby dispense the unit contained thereon, whereby movement of one conveying member through one position actuates only the locking members for the receiving tray associated with that conveying member thereby leaving all of the other receiving trays in a locked orientation to prevent any unauthorized dispensing of the units contained thereon.

* * * * *